US005360676A

United States Patent [19]

Kuguminato et al.

[11] Patent Number: 5,360,676

[45] Date of Patent: Nov. 1, 1994

[54] TIN MILL BLACK PLATE FOR CANMAKING, AND METHOD OF MANUFACTURING

[75] Inventors: Hideo Kuguminato; Toshikatsu Kato; Chikako Fujinaga; Kyoko Hamahara, all of Chiba, Japan

[73] Assignee: Kawasaki Steel Corporation, Japan

[21] Appl. No.: 43,189

[22] Filed: Apr. 6, 1993

[30] Foreign Application Priority Data

Apr. 6, 1992 [JP] Japan ..... 4-084210
Apr. 6, 1992 [JP] Japan ..... 4-084212

[51] Int. Cl.[5] ..... C21D 8/00; C23C 18/00

[52] U.S. Cl. ..... 428/682; 428/679; 148/651; 148/603; 148/529; 427/328

[58] Field of Search ..... 148/320, 651, 603, 529; 427/328; 428/682, 679

[56] References Cited

U.S. PATENT DOCUMENTS 4,889,566 12/1989 Okada et al. ..... 148/651
5,156,694 10/1992 Yamazaki et al. ..... 148/651

*Primary Examiner*—Deborah Yee
*Attorney, Agent, or Firm*—Austin R. Miller

[57] ABSTRACT

A raw plated steel sheet for can comprises recrystallized particles containing approximately C<0,004%, Si<0.03%, Mn:0.05–0.6%, P<0.02%, S<0.02%, N<0.01%, Al:0.005–0.1%, Nb:0,001–0.1%, B:0.0001–0.005% in weight. The maximum diameter of a particle is less than about 30 μm, and an area ratio of particles ranging about 5–25 μm being more than about 50%. Such a steel sheet has excellent processing characteristics and good uniformity in product quality.

6 Claims, 4 Drawing Sheets

TIN MILL BLACK PLATE FOR CANMAKING, AND METHOD OF MANUFACTURING

BACKGROUND OF THE INVENTION

1. Field of the Invention:

The present invention relates to a tin mill black plate for canmaking, such sheet having temper rolling degrees of T1–T6 or DR 8–DR 10. This invention also relates to a method for manufacturing the sheet.

More particularly, the present invention relates to a plated steel sheet for making a three-piece can, the sheet having small thickness, high strength and excellent welding properties. It further relates to a plated steel sheet for making a two-piece can, the sheet having small thickness and excellent drawability. This invention further relates to a method for manufacturing the sheets.

2. Description of the Related Art:

(1) Types of Cans

There are two types of cans made from steel sheet, namely, two-piece cans and three-piece cans. The former can be further classified as SDC (Shallow-Drawn Cans), DRDC (Drawn & Redrawn Cans), DTRC (Drawn & Thin Redrawn Cans), and DWIC (Drawn & Wall Ironed Cans).

(2) Types of Steel Sheets

These cans are manufactured by processes such as deep-drawing, ironing, bending, stretching and welding etc. appropriately tin-coated black plate. The tin mill black plate can be classified, depending on the properties and methods of making the can to be manufactured, into temper degrees of T1–T6 or DR8–DR10. Those black plates having temper degrees of T1–T3 are called soft-temper tin mill black plates while those of T4–T6 are called hard-temper tin mill black plates; both types are made by temper rolling a cold rolled steel sheet once. Meanwhile, classes DR8–DR10 are called DR black plate, manufactured by rolling with a large rolling reduction to the cold rolled steel sheet.

Conventionally, these steel sheets have been manufactured by preparing parent materials having originally different composition, and individually varying the conditions for the hot rolling, the cold rolling, and the annealing etc. for each of them, due to their fundamentally different requirements for strength and processing properties and the like. As a result, the processes have had to be changed each time to meet the requirements for the desired sheet, causing the manufacturing cost to be relatively increased.

(3) Steel Sheet for Three-Piece Cans and Its Problems

Steel sheet for cans must be thin with high strength to reduce cost. The three-piece can is not an exception, but is further required to have high-speed welding properties. In particular, it must provide a high-quality seam by electric seam welding method at more than 70 MPM of welding speed.

However, in the conventional art, reducing the thickness would lead to narrowing of the available welding current range. This is disadvantageous since when a relatively high welding current is supplied, splashing takes place during the welding process to undesirably increase the hardness of the welded portion. As a result, in flange processing steps performed after the cylindrical forming, a flange crack tends to occur at a HAZ (Heat Affected Zone) portion in the weld zone.

Nevertheless, the welding current needs to be relatively high to provide sufficient welding strength, thereby causing HAZ cracking.

Further, in recent steel can manufacturing processes, a coil coating process is carried out on steel sheets. It is desired to apply this coil coating method to steel for high-speed welding, but for this purpose it is necessary to form a non-varnished portion (not a coated portion) in parallel to the rolling direction and to arrange the winding direction of the can body in parallel to the rolling direction.

However, if the can body is wound in this direction and a flange forming process is performed thereafter, HAZ cracking is encountered. Accordingly, in the conventional art, the non-varnished portion (not the coated portion) has been arranged perpendicular to the rolling direction. As a result, high-speed welding could not be applied to the coil coated steel strip.

(4) Steel Sheet for Two-Piece Cans, and Its Problems

Conventional steel sheets for two-piece cans have been made from soft tempered tin mill black plate having excellent deep drawabilities. Further, since such a steel sheet was generally tin-plated, tin played a role as a lubricant during the process and the r-value was not required to be particularly large.

But in the case of using ultra-thin gauge and high strength steel sheet, since the r-value of the steel sheet is generally small, the drawability of the sheet was not desirable since portions around the bottom of the cup-shaped can cracked during the process.

In addition, the larger $\Delta r$-value (planer anisotropy of r-value) increases the earing phenomenon during cup processing, requiring the blank diameter to be uneconomically large.

Moreover, due to the lack of rigidity of the very thin steel sheet, creases occur on the can body wall during pressing, and cracking on the shoulder portion of the punch, respectively.

The same problems as in the hard raw sheet aforementioned took place in the DR raw sheet.

(5) Problem of Coating Weight

The steel sheet is generally subjected to tin-plating. Recently the coating weight of tin has been reduced to reduce cost. For example, while the conventional tin coating weight has been 2.8 $g/m^2$, in the recent sheet that has sometimes been reduced to less than 1 $g/m^2$. In such a case, the corrosion resistance of the steel sheet itself must be improved.

A great deal of effort has been made to cope with the foregoing problems, without success.

For example, Japanese Patent Publication No. Hei 1-52450 discloses a method for manufacturing steel sheets for T1–T3 cans by applying continuous annealing and thereafter temper rolling ultra low carbon steel. However, this method does not overcome all the aforementioned problems.

SUMMARY OF THE INVENTION

Important objects of the present invention are therefore as follows:

(1) To provide an art for manufacturing tin mill black plate having temper degrees of T1–T6 or DR8–DR 10 from cold rolled steel sheets manufactured with the same composition and the same rolling conditions, by changing only the temper rolling conditions;

(2) To provide steel sheets for canmaking having high-speed welding characteristics without causing HAZ cracking;

(3) To provide a tin mill black plate which is capable of arranging the winding direction of a can body parallel to the rolling direction of the sheet and of being welded by high-speed welding;

(4) To provide steel sheets for canmaking having excellent deep drawabilities for very small sheet thickness (so-called ultra-thin gauge) and having high strength; and (5) To provide steel sheets for canmaking having good corrosion resistance even with a small coating weight of tin.

BRIEF DESCRIPTION OF THE INVENTION

In view of the above objects, according to the present invention, a tin mill black plate is provided comprising chemical compositions composed of about C<0.004%, Si<0.03%, Mn:0.05−0.6%, P<0.02%, S<0.02%, N<0.01%, Al:0. 005−0.1%, Nb:0.001−0.1%, B:0.0001−0.005% (all in weight) and incidental impurities, the maximum grain size being less than about 30 μm, and the area ratio of recrystallized grains having a grain size range of 5–25 μm being more than about 50%.

Further, according to the present invention, a method is provided for manufacturing tin mill black plate for canmaking with a maximum recrystallized grain size not exceeding about 30 μm and an area ratio of recrystallized grains having a grain size range of 5–25 μm being more than about 50%, comprising the steps of:

heating to about 1,000°–1,200° C. a steel slab containing about C<0,004%, Si<0. 03%, Mn:0.05–0.6%, P<0.02%, S<0.02%, N<0.01%, Al:0,005–0.1%, Nb: 0.001–0.1%, B:0.0001–0. 005% (all in weight) and incidental impurities;

performing hot rolling of said steel at a finishing temperature of about 800°–900° C. and at a coiling temperature of about 500°–650° C.;

pickling and cold rolling the resulting material; and performing continuous annealing at about 650°–800° C. for a time not exceeding about 60 seconds.

The above and other advantages, features and additional objects of this invention will be manifest to those versed in the art upon making reference to the following detailed description and the accompanying drawings in which embodiments incorporating the principles of this invention are shown by way of illustrative example. Such examples are not intended to define or to limit the scope of the invention as defined in the appended claims.

DETAILED DESCRIPTION OF THE PREFERRED EMBODIMENT

I. BASIC CONCEPT

Figure 1:
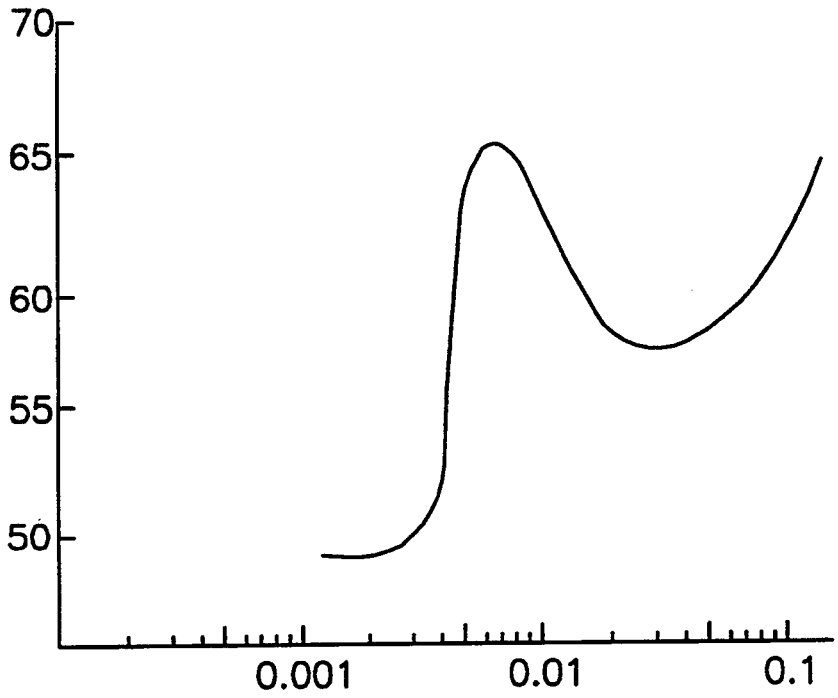
FIG. 1 is a graphic diagram showing a relationship between C content and the hardness of tinplate.

Concentrating their energies on researching steel sheets for cans, the present inventors have discovered phenomena (1)–(4), described in detail as follows, which led to discovery of the present invention:

(1) HAZ Cracking during Manufacturing Processes for Three-Piece Cans

It has been discovered that the C content and the diameter of recrystallized grain size affect the generation of HAZ cracking.

a) Effect of C . . . It is typical that the nugget portion becomes harder when subjected to quick heating to near the melting point and quenching on high-speed welding. In the case of very low carbon steel, on the contrary, that nugget portion becomes softer. Therefore, it is possible to reduce the total thickness of the nugget portion during welding process and thus the amount of deformation during the flange forming process decreases.

b) Effect of crystal grain size . . . An optimum value of the crystal grain size exists. When the crystal grain size is too large it suffers from grain boundary cracking due to stress concentration.

(2) Deep-Drawability of Two-piece Cans

The r value, Δr value and the generation of orange peels are considered to be important factors for the deep-drawability of two-piece cans.

a) The r value and orange peel . . . The r value is enhanced by increase of crystal grain size, but on the other hand orange peels tend to occur. There is discovered to be a certain range for the grain size holding the balance of both. For the adjustment of this range, manufacturing conditions mentioned later play important roles.

b) Δr value . . . For steel sheet for cans, this Δr value in the D direction (direction deflected by 45 degrees from the rolling direction) is degraded due to high cold rolling reduction. But this problem can be overcome by increasing grain size and properly distributing the crystal grains.

(3) Adjustment of Crystal Grain Size

For both two-piece cans and three-piece cans, it is important to control the size of crystal grains of the steel sheet. In view of this, it is important to add a small amount of Nb and B as chemical components of the steel sheet. It is further important to fix N in the steel by adding a proper amount of Al for work-hardening and strain aging.

Furthermore, it is also important to appropriately establish and control the hot rolling conditions, cold rolling conditions and annealing conditions.

We have revealed preferable range conditions and combination conditions of these conditions.

(4) Corrosion Resistance

It has been found that the degrading of the corrosion resistance of lightly tin-coated steel sheet is caused by the precipitation of carbides of crystal grain boundaries on the surface of the steel sheet. For suppressing the precipitation of the carbides, it is preferable to use a composition of Al killed steel containing very low carbon, to perform hot rolling at a temperature lower than the normal temperature, and to apply continuous annealing.

Also, we have found that providing a proper Fe-Ni layer at the surface portion of the plated steel sheet improves corrosion resistance, as well as specific methods for carrying it out.

II. DETAILED EXPLANATION OF THE PRESENT INVENTION (1) Chemical Composition

Figure 3:
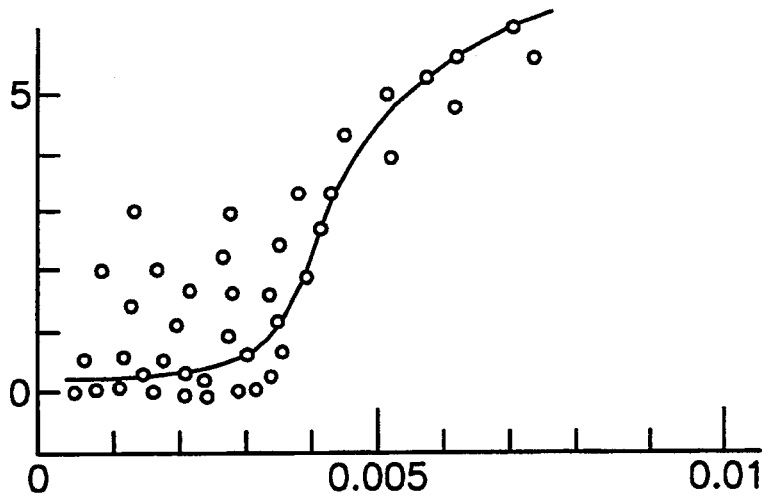
FIG. 3 is a graphic diagram showing a relationship between generated earing and C content.

The C content affects the hardness of steel sheet for tinplate, recrystallized grain size and earing. The influence on hardness is shown in FIG. 1 and that on the earing is shown in FIG. 3. From these data, it is necessary to set the C content to less than about 0.004% and preferably less than about 0,003% for obtaining a temper degree of T1 and reducing the generation of earing on continuous annealing.

Figure 2:
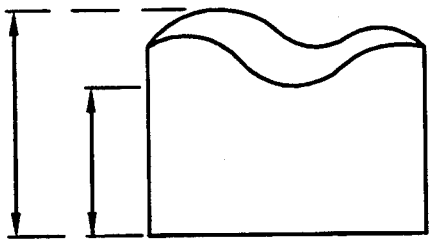
FIG. 2 is a schematic view showing a method for measuring generated earing.

The generation of earing can be assessed in terms of the following formula:

(Hmax–Hmin)/Hmin*100% where Hmax and Hmin stand respectively for the maximum and the minimum height of the can after pressing as shown in FIG. 2.

Si acts to degrade the corrosion resistance of tinplate and further tends to make the steel material extremely hard. It should not be present in an excessive amount. Namely, if the Si content exceeds about 0.03%, the tinplate tends to become too hard, which makes it impossible to provide the temper degrees of T1–T3; it should accordingly be less than about 0.03%.

Mn should be added to prevent the hot rolled coil from cracking at its edge portion. That is, if the Mn content is less than about 0.05%, the cracking cannot be avoided, while if it exceeds about 0.6%, the crystal grain size becomes fine and tinplate itself becomes too hard. Therefore, Mn content should be within a range of about 0.05–0.06%. The Mn amount to be added depends on its relationship to the S content in the steel, as will be mentioned in more detail later.

The element P makes the steel material harder and degrades the corrosion resistance of tinplate and so should be limited to less than about 0.02% of total content.

The element S may cause cracking of the hot-rolled coil at its edge portion and press defects are caused by sulfide inclusions, and should be present in an amount less than about 0.02%. If the ratio Mn/S is less than about 8, the cracking and the press defects would easily arise, so this ratio should exceed about 8.

Al plays a role as a deoxidant in the steel manufacturing process and is added in a proper amount since the cleanliness of the steel would increase proportionally to the increase of the Al content in the steel. However, excessive Al would suppress the growth of the recrystallized grain size of the steel at the same time, so it should be less than about 0.10% in content. On the other hand, if the Al content is less than about 0.005%, the N content in the steel would increase. Therefore, the Al content should be in the range of about 0.005–0.10%.

N tends to become introduced into the steel during the steelmaking process as a result of mixing of N in the air therewith, but a soft steel sheet cannot be obtained if N is present in the solid-state in the steel. Accordingly the N content should be less than about 0.01%.

Too much 0 tends to form oxides with Al and Mn in the steel, with Si in the refractories, and with Ca, Na and F etc. in the flux. Thus, formed oxides tends to cause crack generation during the press working and degradation of the corrosion resistance of the can. Therefore, the O content should be less than about 0.01%.

Nb and B are important elements affecting the recrystallized grain size after annealing. Namely, in an ultra low carbon steel with extremely reduced C content as the steel according to the present invention, the crystal grain size would sometimes become too coarse at about 30 μm, causing orange peel formation as mentioned later. To overcome such a disadvantage and to control the crystal grain size, it is necessary to add both Nb and B together to the steel. Nb is an element necessary to suppress an excessive growth of the crystal particle, and further acts to form carbides or nitrides to reduce the remaining amount of solid-solved C and N, thereby enhancing the processing characteristics of the steel. To obtain these advantages, more than about 0.001% of Nb should be added.

On the other hand, too much Nb would lead to increased recrystallized temperature due to the pinning effect on crystal grain boundary caused by precipitation of Nb. Therefore, the Nb content of the steel should be less than about 0.1%.

B present with Nb contributes to prevent the crystal grains from enlarging too much, and to reduce the secondary work brittleness. Namely, when a carbide forming element is added to an ultra low carbon steel, the strength of the recrystallized grain boundaries would become degraded. Therefore, there is a fear of causing brittle cracking when stored at very low temperature depending on the use of the can and the canning. This can be avoided by adding B to the material. Further, while B forms carbides and nitrides so as to be effective for making the steel softer, it would segregate in the recrystallized grain boundaries during the continuous annealing to retard the recrystallization. Therefore, the B content should be less than about 0.005%, with the lower limit more than about 0.0001% which is necessary to manifest the foregoing advantages.

For the adjustment of the recrystallized grains, a very important point of the present invention, it is preferable to add simultaneously about 0.003–0.02% of Nb and about 0.0003–0.002% of B.

Ti is an element for forming carbide and nitride, and acts to reduce the remaining amount of solid-solved C and solid-solved N for improving the workability of the steel. On the other hand, when too much Ti is added, microscopic observation of the cross-section of a steel sheet will reveal a pointed and sharp and apparently very hard precipitation. In steel sheets for canmaking, such a precipitation would degrade the corrosion resistance of the steel and become a cause of scratching on press working. Therefore, the Ti content should be less than about 0.1% and should be added as required.

Sn, Sb, As and Te are enrichingly concentrated on the steel sheet during the annealing process and can act to prevent C from being enrichingly concentrated, so as to improve the adhesiveness and the corrosion resistance of the tinplate.

Sb and Sn should be added in amounts of more than about 0.001% respectively, while As (more than about 0.001%) and Te (about 0.0001%) should be effective when added. Since an excessive addition of these elements would cause a lowering of the press workability, the upper limit of addition for each respective element should be about 0. 01%.

Ca forms CaO in the molten steel. When $Al_2O_3$, which has a very high melting point and hardness, reacts with this CaO, the $Al_2O_3$ changes into inclusions having lower melting point and hardness. Therefore, even if $Al_2O_3$ remains in the steel sheet by mistake, it would be divided into small pieces in the cold rolling process because of its softness so as not to cause any degradation of the product quality. Accordingly, the Ca content can be more than about 0.0001%, but with an upper limit of less than about 0.005% since too much Ca would undesirably increase the non-metallic inclusions.

All of Mo, V, Zr act to increase the recrystallizing temperature during the continuous annealing process. Further, Cr, Cu, Ni, Na, Mg and REM increase the recrystallizing temperature as well as reduce the rolling characteristics of the steel, such that they may make it difficult to anneal the sheet continuously and to cold roll the steel sheet to a very thin gauge. Therefore, it would be preferable to limit the contents of these elements as follows: Mo, V, Zr . . . . less than about 0.01%; Cr, Cu, Ni . . . . less than about 0.1%; Na, Mg . . . . less than about 0.001%; and REM . . . . less than about 0.005%.

(2) Size of crystal grains

But too large and too small crystal grains frequently cause HAZ cracking.

Figure 6:
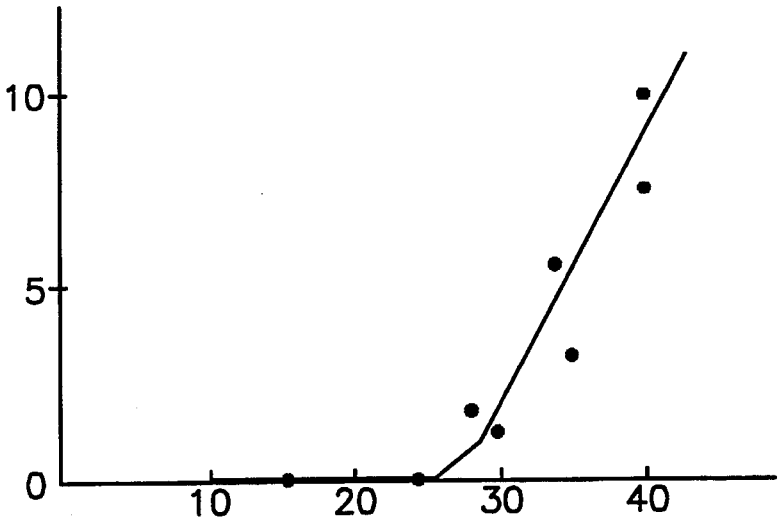
FIG. 6 is a graphic diagram showing a relationship between a diameter of maximum crystal grain size and HAZ crack generating rate.

FIG. 6 shows a relationship between the diameter of maximum crystal grains and HAZ cracking when the winding direction of the can body is in parallel to the rolling direction of the steel sheet, not perpendicular to the rolling direction as in the conventional method.

From FIG. 6 it should be understood that when the can body winding direction is parallel to the steel sheet rolling direction, HAZ cracking frequently arises unless the diameter of the maximum recrystallized grain is less than about 30 μm, preferably less than about 25 μm.

Figure 7:
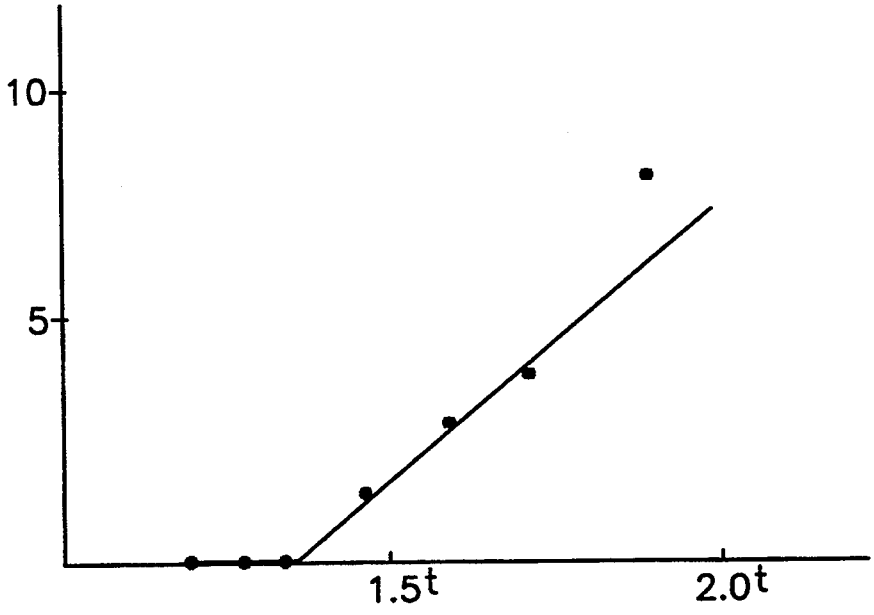
FIG. 7 is a graphic diagram showing a relationship between total sheet thickness at weld zone and HAZ crack generating rate.

On the other hand, FIG. 7 shows a relationship between the degree of reduction of thickness of the weld zone and HAZ cracking when the body of the three-piece can is bonded by high-speed welding.

As shown in FIG. 7, a severe stress concentration occurs during the flange forming process when the total thickness of the weld zone exceeds 1.4 times of the thickness of material steel sheet, leading to frequent HAZ cracking.

The total thickness of the weld zone is affected by the diameter of the recrystallized grains of the steel sheet. According to experiments carried out by the present inventors, it has been found that if the area ratio of crystal particles of more than 5 μm exceeds about 50%, the total thickness of the weld zone would become less than about 1.4 times of the thickness of material steel sheet.

Figure 4:
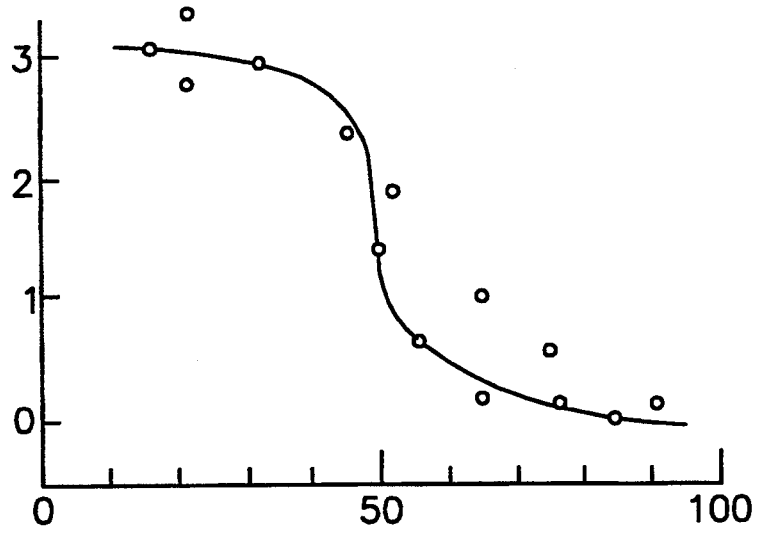
FIG. 4 is a graphic diagram showing influence of area ratio of recrystallized grain size ranging 5–25 μm on the generation of earing.

FIG. 4 is a graphic diagram showing a relationship between area ratio of recrystallized particles ranging about 5–25 μm and earing when tin-plated steel sheet of ultra low carbon steel with a C content of less than about 0,004% is deep-drawn.

As shown in FIG. 4, when the area ratio of the recrystallized grains ranging about 5–25 μm is less than about 50%, earing is easily generated and the material is not suitable as a material for two-piece canmaking.

Further, it has been revealed that the upper limit of the crystal grain size which would generate orange peeling is about 30 μm, and if the grain size exceeds that value, orange peeling would frequently take place.

In view of the foregoing points, the crystal grain size required for the tinplate should be less than about 30 μm for all the crystal grains, and the area ratio thereof ranging about 5–25 μm should exceed about 50%.

The crystal grain size can be measured in such a manner that a cross section rolling direction of the tinplate is observed by a microscope, and then the dimensions in the long and short diameter directions are averaged. Further, the area ratio of the recrystallized grains ranging about 5–25 μm refers to the ratio of the recrystallized grains ranging about 5–25 μm, under a microscopic observation, in proportion to the total cross sectional area of the tinplate.

(3) Rolling conditions

To obtain crystal grain sizes after the annealing process as mentioned above, it is necessary to appropriately control the hot rolling finishing temperature. Both too high and too low FDT (finishing temperature) would make the recrystallized grain size unnecessarily enlarged.

Also, particularly in steel sheets for canmaking, the finishing hot rolling thickness would be so small as about 2–3 mm due to the small product thickness. As a result, the rolling time would become long due to its relationship to the capacity of the hot rolling mill, leading to a significant temperature lowering. Therefore, for increase FDT a very high SRT (slab reheating temperature) a problem as will mentioned later would arise and the temperature lowering during the rolling process becomes intense so as to cause dispersion of product quality. Therefore, FDT should be set at about 800°–900° C. for desirable crystal diameter, product uniformity and less carbide deposition.

Further, too high SRT would easily cause cracking on the roll surface by thermal shock, which leads to reduced roll service life and more surface defects in the steel strip. Meanwhile, if SRT is less than about 1000° C., it becomes impossible to keep FDT.

If CT (coiling temperature) is increased, the recrystallization and crystal grain growing would be easily generated so as to develop a recrystallized texture that is desirable for improving the deep drawabilities of the steel.

However, when CT is high, the material quality would deteriorate as the temperature increasingly drops at the top and tail ends of the steel strip. Moreover, the pickling properties would be affected due to increased scale developing on the hot rolled steel sheet. Accordingly, CT should be set at less than about 650° C. Further, since too low CT would cause excessively fine crystal particles, it should be set at more than about 500° C. for lowering the rolling characteristics.

As set forth above, the hot rolled steel strip is pickled, cold rolled, and continuously annealed at about 650°–800° C. for less than about 60 seconds.

The cold rolling reduction ratio affects the crystal grain size, and if it is too small, the crystal grain size becomes excessively coarse and tends to lower the uniformity of the grain size. Accordingly, the rolling reduction ratio should be more than about 80%.

Too low continuous annealing temperature makes the product too hard while too high temperature leads to an excessively coarse grain. Accordingly, the continuous annealing is carried out at about 650° C.–800° C. For good productivity, annealing time should be less than about 60 seconds.

The steel sheet thus processed is then subjected to temper rolling with a properly selected rolling reduction ratio so as to become a steel sheet for canmaking with a desirable temper degree of T1–T6 or DR8–DR 10.

Figure 5:
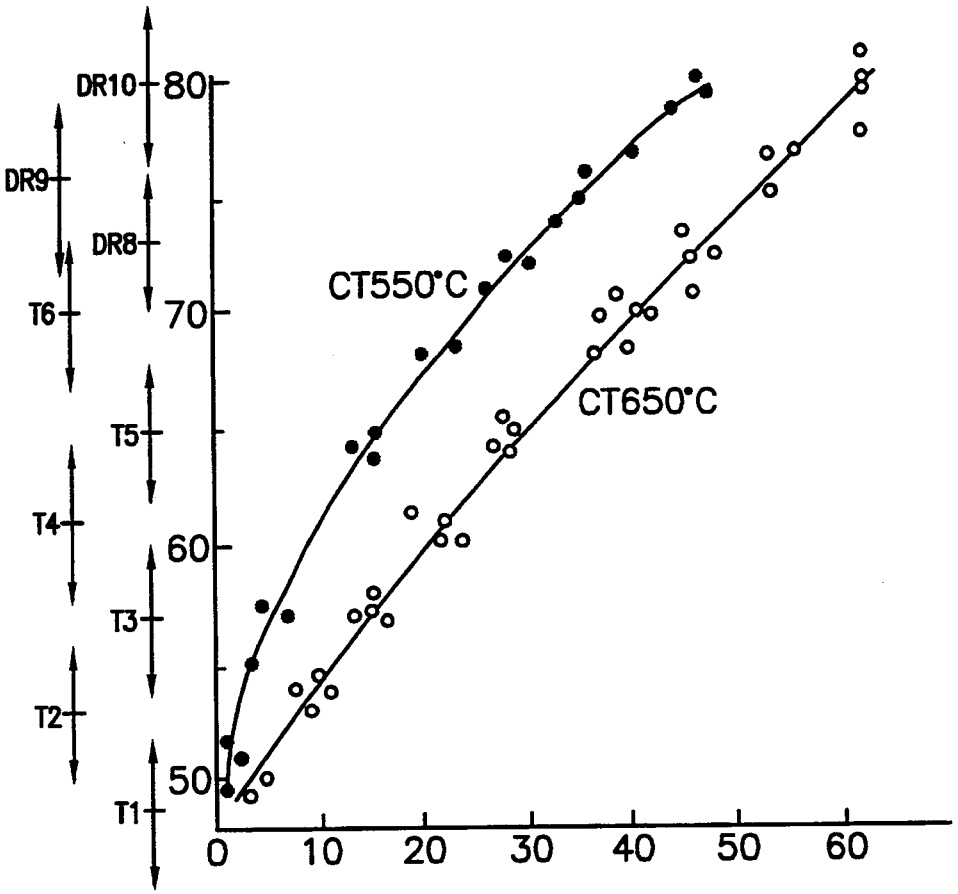
FIG. 5 is a graphic diagram showing a relationship between a hardness of tinplate and temper rolling reduction.

An example of a relationship between the temper degree (HR30T) and the temper rolling reduction ratio is shown in FIG. 5.

As shown in FIG. 5, a steel sheet with a temper degree T1 (49±3 in HR30T) can be produced by applying temper rolling to a continuously annealed sheet with several % of rolling reduction ratio. For that with T2, the rolling reduction ratio may be selected as approximately 10%. In this manner, the rolling reduction ratio can be selected for a desired temper rolling reduction ratio from FIG. 5. Thus, according to the present invention, steel sheets for canmaking of all temper degrees can be manufactured with the same steel.

(4) Ni treatment

By applying Ni plating and annealing for diffusing Ni to the steel sheet, Ni and Fe are completely alloyed to form an Fe—Ni alloy layer having an improved corrosion resistance. This Fe—Ni alloy layer itself has very excellent corrosion resistance. Further, it has good rust resistance and corrosion resistance because of the potential being closer to Fe than Ni. Therefore, Fe would not easily melt even when any flaw reaching the base steel portion is given.

When the weight ratio of Ni/(Fe+Ni) in Fe—Ni alloy layer formed at the surface layer of the steel sheet according to the present invention is less than about 0.01, the corrosion resistance and the rust resistance of Fe—Ni alloy layer itself would be insufficient. If it exceeds about 0.3, when a defect such as a scratch or scrape reaching the base steel sheet, the base steel sheet would intensely dissolve in solution from the defective portion.

The thickness of the Fe—Ni alloy layer is about 10—4000 Å, preferably about 200–4000 Å. If the thickness of the Fe—Ni alloy layer is less than about 10 Å, the rust resistance and the corrosion resistance properties of the steel would be insufficient. Meanwhile, if the thickness exceeds about 4000 Å, defects such as peeling would be easily generated due to the high hardness and brittleness of Fe—Ni alloy when shaping processes such as the neck flange forming process, beat process, deep-drawing process and overhang process are applied to two-piece cans produced from such a steel sheet, thereby reducing the rust resistance and the corrosion resistance of the product.

The Ni diffusion treated steel sheet is manufactured according to the present invention, as firstly providing a cold rolled steel sheet by any known method, next Ni plating of about 0.02–0.5 g/m$^2$ on the surface of the steel sheet obtained by the cold rolling, subsequently forming an Fe—Ni alloy layer having an weight ratio Ni/(Fe+Ni) of about 0.01–0.3 and a thickness of about 10–4000 Å on the steel sheet surface layer by continuously annealing the Ni-plated member in a reducing atmosphere to diffuse Ni into the base steel sheet, temper-rolling the alloy layer-formed steel sheet using a rust-resistant rolling oil; and finally forming a rust-resistant oil film having a dry weight of about 1–100 mg/m$^2$ on the surface of the temper-rolled steel sheet.

If the Ni-plating amount is less than about 0.02 g/m$^2$, the corrosion resistance decreases. Meanwhile if it exceeds about 0.5 g/m$^2$, the corrosion resistance cannot be improved any more and a disadvantage in cost would arise.

The present invention will now be illustrated specifically on the basis of a selected specific series of embodiments.

A steel having a composition shown in Table 1 was melted by a bottom-blowing steel converter of 270 t and was converted into a steel such as that containing 0.03% C. After decarburizing the steel to not exceed 0.004% of C by applying an R-H vacuum degassing process, Al and subsequently carbide forming elements, nitride forming elements and elements concentrating on the steel surface were separately added to the steel. These steels were produced by using a continuous casting machine and inclusions were removed after making them float to the top portion of the molten steel so as to provide high cleanliness to the steel. Thus obtained steel slabs were rolled at the hot-rolling temperature shown in Table 2 to form hot-rolled coils having a thickness of 2.0 mm, and were then pickled and descaled. After cold rolling the hot-rolled coil into a cold rolled strip having a very small sheet thickness of 0.2 mm (rolling reduction ratio 90%) by a 6 stand tandem cold-rolling mill, the cold rolled strip was continuously annealed in a HNX gas atmosphere (10% $H_2$+90% $N_2$). The heat cycle was performed at temperatures shown in Table 2 for a level of 60 seconds. Successively, the annealed member was then temper-rolled by a temper-rolling mill with a rolling reduction ratio selected as shown in Table 2 to produce steel sheets of a variety of temper degree.

The steel sheets having been temper-rolled were then subjected to a tin-plating and a reflow treatment (tin-remelting and alloying) successively during a horizontal halogen bath type electrolytic tinning process so as to provide a tinplate having coating weight of 2.8 g/m$^2$. Further, TFS (Tin Free Steel) was obtained by applying an electrolytic chromium coating process under the following conditions to the temper-rolled steel sheets. Samples were cut off from the thus treated sheets and hardness was measured. The Lankford value, $\bar{r}$, was measured by a proper oscillation method. Earing was also measured. In addition, the fruiting resistance was tested by bending the sample. The quantification of this fruiting test was made by applying a degree of bending which would correspond to the shape of the can body to the sample, and by judging the generated bend as to whether it was still worthy as an article of commerce (indicated by "o") or not (indicated by "x").

Furthermore, as to the tin mill black plate, the distribution of hardness before and after the temper rolling was measured at the widthwise end of the member, the center, and the other widthwise end of the member for estimation of the uniformity of mechanical properties of the steel strip manufactured. This is shown in Table 2. From these results, it is clear that the steel sheet manufactured according to the present invention is superior to the compared reference steel sheet in processing characteristics and uniformity of the material quality.

The following is provided to indicate the conditions used in Sn plating bathing and in flowing:

| | | | |
|---|---|---|---|
| Composition: | tin chloride | 75 g/l | pH 2. 7 |
| | thorium fluoride | 25 g/l | |
| | potassium bifluoride | 50 g/l | |
| | sodium chloride | 45 g/l | |
| | $Sn^{2+}$ | 36 g/l | |
| | $Sn^{4+}$ | 1 g/l | |
| Bathing temperature: | 65° C. | | |
| Current density: | 48 A/dm$^2$ | | |

-continued

| | |
|---|---|
| Reflowing: | electric heating (280° C.) |

The following sets forth the conditions used in chromating process bathing:

| | | |
|---|---|---|
| Composition: | $CrO_3$ | 180 g/l |
| | $H_2SO_4$ | 0.758 g/l |
| | $Na_2SiF_6$ | 8 g/l |
| Processing conditions: | liquid temperature | 50° C. |
| | current density | 80 A/dm$^2$ |
| | cathode processing time | 1.2 sec |

TABLE 1

| | | Steel Composition (wt %) | | | | | | | | | | | |
|---|---|---|---|---|---|---|---|---|---|---|---|---|---|
| Steel | Examples | C | Si | Mn | P | S | N | Al | Nb | Ti | Cr | Cu | Ni |
| 1 | Present | 0.002 | 0.02 | 0.20 | 0.015 | 0.011 | 0.0031 | 0.052 | 0.0026 | 0.001 | 0.02 | 0.01 | 0.01 |
| 2 | Invention | 0.002 | 0.02 | 0.20 | 0.015 | 0.011 | 0.0031 | 0.052 | 0.0026 | 0.001 | 0.02 | 0.01 | 0.01 |
| 3 | | 0.002 | 0.02 | 0.20 | 0.015 | 0.011 | 0.0031 | 0.052 | 0.0026 | 0.001 | 0.02 | 0.01 | 0.01 |
| 4 | | 0.002 | 0.02 | 0.20 | 0.015 | 0.011 | 0.0031 | 0.052 | 0.0026 | 0.001 | 0.02 | 0.01 | 0.01 |
| 5 | | 0.002 | 0.02 | 0.20 | 0.015 | 0.011 | 0.0031 | 0.052 | 0.0026 | 0.001 | 0.02 | 0.01 | 0.01 |
| 6 | | 0.002 | 0.02 | 0.20 | 0.015 | 0.011 | 0.0031 | 0.052 | 0.0026 | 0.001 | 0.02 | 0.01 | 0.01 |
| 7 | | 0.002 | 0.02 | 0.20 | 0.015 | 0.011 | 0.0031 | 0.052 | 0.0026 | 0.001 | 0.02 | 0.01 | 0.01 |
| 8 | Comparative | 0.006 | 0.03 | 0.38 | 0.014 | 0.018 | 0.0042 | 0.091 | 0.0031 | 0.001 | 0.03 | 0.01 | 0.001 |
| 9 | | 0.003 | 0.01 | 0.10 | 0.013 | 0.010 | 0.0021 | 0.152 | 0.126 | 0.001 | 0.03 | 0.01 | 0.001 |
| 10 | Present | 0.003 | 0.02 | 0.25 | 0.003 | 0.005 | 0.0015 | 0.078 | 0.053 | 0.001 | 0.04 | 0.01 | 0.001 |
| 11 | Invention | 0.003 | 0.02 | 0.25 | 0.003 | 0.005 | 0.0015 | 0.078 | 0.053 | 0.001 | 0.04 | 0.01 | 0.001 |
| 12 | Comparative | 0.008 | 0.04 | 0.66 | 0.015 | 0.011 | 0.0121 | 0.078 | 0.002 | 0.134 | 0.05 | 0.01 | 0.001 |
| 13 | | 0.008 | 0.04 | 0.66 | 0.015 | 0.011 | 0.0121 | 0.078 | 0.002 | 0.134 | 0.05 | 0.01 | 0.001 |
| 14 | Present | 0.001 | 0.02 | 0.06 | 0.009 | 0.009 | 0.0093 | 0.184 | 0.001 | 0.021 | 0.03 | 0.01 | 0.005 |
| 15 | Invention | 0.004 | 0.03 | 0.15 | 0.005 | 0.008 | 0.0015 | 0.083 | 0.001 | 0.081 | 0.08 | 0.04 | 0.001 |
| 16 | Comparative | 0.004 | 0.03 | 0.15 | 0.005 | 0.008 | 0.0015 | 0.083 | 0.001 | 0.081 | 0.08 | 0.04 | 0.001 |
| 17 | | 0.004 | 0.03 | 0.15 | 0.005 | 0.008 | 0.0015 | 0.083 | 0.001 | 0.081 | 0.08 | 0.04 | 0.001 |
| 18 | | 0.001 | 0.02 | 0.15 | 0.008 | 0.008 | 0.0015 | 0.041 | <0.001 | 0.001 | 0.02 | 0.01 | 0.001 |

| | | Steel Composition (wt %) | | | | | | | | | | | | |
|---|---|---|---|---|---|---|---|---|---|---|---|---|---|---|
| Steel | Examples | B | Mo | O | V | Zr | Ca | Sn | Sb | REM | Na | Mg | As | Te |
| 1 | Present | 0.0001 | 0.001 | 0.0037 | 0.001 | 0.002 | 0.0001 | 0.003 | 0.001 | 0.001 | 0.0001 | 0.0001 | 0.005 | 0.003 |
| 2 | Invention | 0.0001 | 0.001 | 0.0037 | 0.001 | 0.002 | 0.0001 | 0.003 | 0.001 | 0.001 | 0.0001 | 0.0001 | 0.005 | 0.003 |
| 3 | | 0.0001 | 0.001 | 0.0037 | 0.001 | 0.002 | 0.0001 | 0.003 | 0.001 | 0.001 | 0.0001 | 0.0001 | 0.005 | 0.003 |
| 4 | | 0.0001 | 0.001 | 0.0037 | 0.001 | 0.002 | 0.0001 | 0.003 | 0.001 | 0.001 | 0.0001 | 0.0001 | 0.005 | 0.003 |
| 5 | | 0.0001 | 0.001 | 0.0037 | 0.001 | 0.002 | 0.0001 | 0.003 | 0.001 | 0.001 | 0.0001 | 0.0001 | 0.005 | 0.003 |
| 6 | | 0.0001 | 0.001 | 0.0037 | 0.001 | 0.002 | 0.0001 | 0.003 | 0.001 | 0.001 | 0.0001 | 0.0001 | 0.005 | 0.003 |
| 7 | | 0.0001 | 0.001 | 0.0037 | 0.001 | 0.002 | 0.0001 | 0.003 | 0.001 | 0.001 | 0.0001 | 0.0001 | 0.005 | 0.003 |
| 8 | Comparative | 0.0001 | 0.001 | 0.0053 | 0.001 | 0.002 | 0.0001 | 0.002 | 0.001 | 0.002 | 0.0001 | 0.0001 | 0.001 | 0.0001 |
| 9 | | 0.0002 | 0.001 | 0.0027 | 0.001 | 0.001 | 0.0010 | 0.005 | 0.001 | 0.001 | 0.0001 | 0.0001 | 0.007 | 0.004 |
| 10 | Present | 0.0043 | 0.001 | 0.0014 | 0.001 | 0.001 | 0.0021 | 0.005 | 0.001 | 0.001 | 0.0001 | 0.0001 | 0.005 | 0.0012 |
| 11 | Invention | 0.0043 | 0.001 | 0.0014 | 0.001 | 0.001 | 0.0021 | 0.005 | 0.001 | 0.001 | 0.0001 | 0.0001 | 0.005 | 0.0012 |
| 12 | Comparative | 0.0001 | 0.001 | 0.0163 | 0.001 | 0.001 | 0.0001 | 0.004 | 0.001 | 0.001 | 0.0001 | 0.0001 | 0.001 | 0.0001 |
| 13 | | 0.0001 | 0.001 | 0.0163 | 0.001 | 0.001 | 0.0001 | 0.004 | 0.001 | 0.001 | 0.0001 | 0.0001 | 0.001 | 0.0001 |
| 14 | Present | 0.0013 | 0.006 | 0.0032 | 0.003 | 0.001 | 0.0001 | 0.004 | 0.001 | 0.003 | 0.001 | 0.0001 | 0.001 | 0.0001 |
| 15 | Invention | 0.0005 | 0.001 | 0.0041 | 0.001 | 0.001 | 0.0001 | 0.008 | 0.004 | 0.0001 | 0.0001 | 0.0001 | 0.001 | 0.0001 |
| 16 | Comparative | 0.0005 | 0.001 | 0.0041 | 0.001 | 0.001 | 0.0001 | 0.008 | 0.004 | 0.0001 | 0.0001 | 0.0001 | 0.001 | 0.0001 |
| 17 | | 0.0005 | 0.001 | 0.0041 | 0.001 | 0.001 | 0.0001 | 0.008 | 0.004 | 0.0001 | 0.0001 | 0.0001 | 0.001 | 0.0001 |
| 18 | | <0.0001 | 0.001 | 0.0031 | 0.001 | 0.001 | 0.0001 | 0.005 | 0.004 | 0.001 | 0.001 | 0.0001 | 0.001 | 0.0001 |

TABLE 2

| | | | | | | Crystal Grain Size | | Temper | Qualities of Tinplate and T.F.S. | | | | |
|---|---|---|---|---|---|---|---|---|---|---|---|---|---|
| Steel | Surface Treatment | Hot Rolling (°C.) SRT | FDT | CT | CAL Max. Temp. (°C.) | Max | Area Ratio of 25 to 5 μm | Rolling Reduction Ratio (%) | Hardness (HR30T) | $\bar{r}$ | Δr | Earing (%) | Temper Rolling Degree |
| 1 | Tinplate | 1150 | 840 | 600 | 800 | 26 | 85 | 1 | 49 | 1.8 | −0.04 | 0 | T1 |
| 2 | T.F.S. | 1150 | 840 | 600 | 800 | 26 | 85 | 10 | 56 | 1.7 | −0.01 | 0.5 | T3 |
| 3 | Tinplate | 1150 | 840 | 600 | 750 | 26 | 85 | 20 | 61 | 1.7 | −0.13 | 1.4 | T4 |
| 4 | T.F.S. | 1150 | 840 | 600 | 750 | 26 | 85 | 30 | 69 | 1.4 | −0.15 | 1.5 | T6 |
| 5 | Tinplate | 1150 | 840 | 600 | 700 | 26 | 85 | 40 | 73 | 1.3 | −0.22 | 1.7 | DR8 |
| 6 | T.F.S. | 1150 | 840 | 600 | 700 | 26 | 85 | 50 | 76 | 1.2 | −0.31 | 1.9 | DR9 |
| 7 | Tinplate | 1150 | 840 | 600 | 650 | 26 | 85 | 60 | 81 | 1.2 | −0.34 | 2.1 | DR10 |
| 8 | | 1160 | 890 | 640 | 750 | 24 | 45 | 1 | 55 | 1.0 | −0.62 | 5.0 | T2.5 |
| 9 | | 980 | 780 | 650 | 750 | 36 | 80 | 1 | 63 | 0.8 | −0.70 | 6.0 | T4 |
| 10 | | 1050 | 810 | 630 | 750 | 27 | 80 | 1 | 48 | 1.7 | −0.03 | 0 | T1 |
| 11 | | 1180 | 870 | 610 | 750 | 25 | 74 | 1 | 50 | 1.8 | −0.01 | 0 | T1 |
| 12 | | 1180 | 910 | 650 | 750 | 38 | 82 | 1 | 49 | 1.7 | −0.03 | 0 | T1 |
| 13 | | 1180 | 870 | 680 | 750 | 40 | 90 | 1 | 50 | 1.8 | −0.01 | 0 | T1 |
| 14 | Tinplate | 1150 | 850 | 540 | 800 | 25 | 60 | 1 | 50 | 1.6 | −0.14 | 1.3 | T1 |
| 15 | | 1150 | 860 | 570 | 800 | 24 | 54 | 1 | 50 | 1.5 | −0.12 | 1.4 | T1 |

TABLE 2-continued

| | | | | | | | | | | | | |
|---|---|---|---|---|---|---|---|---|---|---|---|---|
| 16 | | 1150 | 860 | 570 | 820 | 24 | 95 | 1 | 42 | 1.5 | −0.62 | 4.2 | Not T1 |
| 17 | | 1150 | 860 | 570 | 630 | 24 | 40 | 1 | 57 | 0.9 | −0.83 | 5.3 | T3 |
| 18 | | 1150 | 840 | 540 | 780 | 38 | 35 | 1 | 39 | 0.9 | −0.50 | 4.0 | Not T1 |

| | | | Hardness Distribution (HR30T) | | | | | | |
|---|---|---|---|---|---|---|---|---|---|
| | Steel | Unti-Fruiting | Before Temper Rolling | | | After Temper Rolling | | | Overall |
| Steel | Surface | Properties | E | C | E | E | C | E | Appraisals |
| 1 | Tinplate | ○ | 48 | 49 | 48 | 49 | 50 | 50 | ○ |
| 2 | T.F.S. | ○ | 55 | 56 | 56 | 56 | 56 | 56 | ○ |
| 3 | Tinplate | ○ | 61 | 60 | 61 | 61 | 60 | 60 | ○ |
| 4 | T.F.S. | ○ | 68 | 69 | 70 | 69 | 69 | 69 | ○ |
| 5 | Tinplate | ○ | 72 | 73 | 73 | 74 | 74 | 74 | ○ |
| 6 | T.F.S. | ○ | 76 | 75 | 76 | 75 | 76 | 75 | ○ |
| 7 | | ○ | 80 | 81 | 81 | 81 | 80 | 81 | ○ |
| 8 | | x | 55 | 56 | 55 | 54 | 57 | 54 | x |
| 9 | | ○ | 55 | 64 | 51 | 54 | 63 | 52 | x |
| 10 | | ○ | 47 | 48 | 47 | 48 | 48 | 48 | ○ |
| 11 | | ○ | 49 | 50 | 50 | 50 | 50 | 49 | ○ |
| 12 | | ○ | 53 | 48 | 54 | 55 | 49 | 56 | x |
| 13 | | ○ | 54 | 49 | 55 | 56 | 50 | 56 | x |
| 14 | Tinplate | ○ | 49 | 49 | 49 | 49 | 50 | 51 | ○ |
| 15 | | ○ | 50 | 50 | 51 | 49 | 50 | 49 | ○ |
| 16 | | ○ | 37 | 42 | 36 | 35 | 43 | 36 | x |
| 17 | | x | 60 | 56 | 59 | 61 | 57 | 60 | x |

T.F.S.: Tin Free Steel
E: Plate width end portion; C: Center portion);

TABLE 3

| | | Evaluation of Characteristics in Canmaking Process | | | | | | |
|---|---|---|---|---|---|---|---|---|
| | | Welded Can HAZ Crack after Neck-in Flange | DRD Can for Tuna Manufactured by Pressing After Coil Coating | | | | DWI can | |
| Steel | Steel Surface | Process After Coiling 90 Degrees From Rolling Direction | Earing (%) | Body Rupture | Rumple | Orange Peel | Mat Finish Steel Sheet, Tin Costing 2.8 g/m, No Reflow | S Can |
| 1 | Tinplate | | | | | | | Good |
| 2 | T.F.S. | | | | | | Good | |
| 3 | Tinplate | | | | | | Good | |
| 4 | T.F.S. | | 1.5 | No | No | No | | |
| 5 | Tinplate | No HAZ | | | | | | |
| 6 | T.F.S. | | 1.9 | No | No | No | | |
| 7 | Tinplate | No HAZ | | | | | | |
| 8 | | | 5.0 | Yes | Yes | No | | |
| 9 | | | 6.0 | Yes | Yes | Yes | | |
| 10 | | | 0.0 | No | No | No | | |
| 11 | | No HAZ | | | | | | |
| 12 | | | 0.0 | No | No | Yes | | |
| 13 | | | 0.0 | No | No | Yes | | |
| 14 | | | | | | | Good | |
| 15 | | No HAZ | | | | | | |
| 16 | | | 4.2 | No | No | No | | |
| 17 | | | 5.3 | Yes | Yes | Yes | | |
| 18 | | | 4.0 | Yes | Yes | Yes | | |

T.F.S.: Tin Free Steel

What is claimed is:

1. A steel sheet for canmaking comprising about:
C not exceeding 0.004%;
Si not exceeding 0.03%;
Mn 0.05–0.6%;
P not exceeding 0.02%;
S not exceeding 0.02%;
N less than 0.01%;
Al 10.005–0.1%;
Nb 0.001–0.1%;
B 0.0001–0.005%; and
the remainder Fe except incidental impurities;
wherein the recrystallized grain size of said steel sheet does not exceed about 30 μm; and
the area ratio of recrystallized grains which ranges from about 5–25 μm is equal to or more than about 50%, said steel sheet including an Fe—Ni alloy layer having a weight ratio Ni/(Fe+Ni) of about 0.01–0.3 and a thickness of about 10–4000 Å at the surface part.

2. The steel sheet defined in claim 1, wherein said steel sheet further comprises, Ti in an amount less than about 0.1%.

3. The steel sheet defined in claim 1, wherein said steel sheet further comprises any of the following elements in about the specified amounts:
Sn equal to or more than 0.01%;
Sb equal to or more than 0.001%;
As equal to or more than 0.001%; or
Te equal to or more than 0.0001%.

4. The steel sheet defined in claim 1, wherein said steel sheet further comprises Ti in an amount of less than about 0.1%, and wherein said steel sheet further comprises any of the following elements in about the specified amounts:

Sn equal to or more than 0.01%;

Sb equal to or more than 0.001%;

As equal to or more than 0.001%; or

Te equal to or more than 0.0001%.

5. A method for manufacturing a steel sheet for can-making comprising about: C not exceeding 0.004%, Si not exceeding 0.03%, Mn 0.05–0.6 P not exceeding 0.02%, S not exceeding 0.02%, N less than 0.01%, Al 0.005–0.1%, Nb 0.001–0.1%, B 0.0001–0.005% and the remainder Fe except incidental impurities, wherein the recrystallized grain size of said steel sheet does not exceed about 30 μm, and the area ratio of recrystallized grains which ranges from about 5–25 μm is equal to or more than about 50%, said steel sheet including an Fe—Ni alloy layer having a weight ratio Ni/(Fe+Ni) of about 0.01–0.3 and a thickness of about 10–4000 Å at the surface part, comprising the steps of:

heating at a temperature of about 1,00020 -1,200° C. a continuously molded slab containing C in an amount not exceeding about 0.004%, Si in an amount not exceeding about 0.03%, Mn in an amount not exceeding about 0.05–0.6%, P in an amount not exceeding about 0.02%, S in an amount not exceeding about 0.02%, N in an amount less than about 0.01%, Al in an amount of about 0.005–0.1%, Nb in an amount of about 0.001–0.1%, and B in an amount of about 0.0001–0.005%, with the residual part being substantially Fe.

hot-rolling the heated slab with a finishing temperature of about 800°–900° C. and a coiling temperature of about 500°–650° C. for providing a hot-rolled steel strip;

pickling and cold rolling the hot-rolled steel sheet to provide a cold rolled steel strip;

applying said Fe—Ni alloy layer to the surface of said sheet;

continuously annealing the cold rolled steel sheet at about 650°–800° C. for not exceeding about 60 seconds; and thereafter temper-rolling the continuously annealed steel sheet.

6. A method for manufacturing a steel sheet for can-making comprising about: C not exceeding 0.004%, Si not exceeding 0.03%, Mn 0.05–0.6%, P not exceeding 0.02%, S not exceeding 0.02%, N less than 0.01%, Al0.005–0.1%, Nb0.001–0.1%, B 0.0001–0.005% and the remainder Fe except incidental impurities, wherein the recrystallized grain size of said steel sheet does not exceed about 30 μm, and the area ratio of recrystallized grains which ranges from about 5–25 μm is equal to or more than about 50%, said steel sheet including an Fe—Ni alloy layer having a weight ratio Ni/(Fe+Ni) of about 0.01–0.3 and a thickness of about 10–4000 Å at the surface part, comprising the steps of:

heating at a temperature of about 1,000°–1,200° C. a continuously molded slab containing C in an amount not exceeding about 0.004%, Si in an amount not exceeding about 0.03%, Mn in an amount not exceeding about 0.05–0.6%, P in an amount not exceeding about 0.02%, S in an amount not exceeding about 0.02%, N in an amount less than about 0.01%, Al in an amount of about 0.005–0.1%, Nb in an amount of about 0.001–0.1%, and B in an amount of about 0.0001–0.005%, with the residual part being substantially Fe, hot-rolling the heated slab with a finishing temperature of about 800°–900° C. and a coiling temperature of about 500°–650° C. for providing a hot-rolled steel strip;

pickling and cold rolling the hot-rolled steel sheet to provide a cold rolled steel strip;

plating Ni in an amount of about 0.02 to 0.5 g/m$^2$ on the cold rolled steel strip; and thereafter continuously annealing the Ni-plated member in a reducing atmosphere to diffuse Ni into the base steel sheet.

* * * * *

UNITED STATES PATENT AND TRADEMARK OFFICE

CERTIFICATE OF CORRECTION

PATENT NO. : 5,360,676

DATED : November 1, 1994

INVENTOR(S) : Hideo Kuguminato et al

It is certified that error appears in the above-indentified patent and that said Letters Patent is hereby corrected as shown below:

In column 15, line 9, after "0.05-0.6" insert a comma --%,--.
line 20, delete 1,00020 and substitute --1,000° C--;
line 31, delete the period "." and substitute a comma --,--.

Signed and Sealed this

Twenty-fourth Day of January, 1995

*Attest:*

Bruce Lehman

BRUCE LEHMAN

*Attesting Officer*

*Commissioner of Patents and Trademarks*